US010674268B2

(12) United States Patent
Woelfl

(10) Patent No.: US 10,674,268 B2
(45) Date of Patent: Jun. 2, 2020

(54) SYSTEM AND METHOD FOR OPERATING A WEARABLE LOUDSPEAKER DEVICE

(71) Applicant: Harman Becker Automotive Systems GmbH, Karlsbad (DE)

(72) Inventor: Genaro Woelfl, Salching (DE)

(73) Assignee: HARMAN BECKER AUTOMOTIVE SYSTEMS GMBH, Karlsbad (DE)

( * ) Notice: Subject to any disclaimer, the term of this patent is extended or adjusted under 35 U.S.C. 154(b) by 225 days.

(21) Appl. No.: 15/668,528

(22) Filed: Aug. 3, 2017

(65) Prior Publication Data

US 2018/0041837 A1 Feb. 8, 2018

(30) Foreign Application Priority Data

Aug. 4, 2016 (EP) ..... 16182781

(51) Int. Cl.

| | |
|---|---|
| ***H04R 5/02*** | (2006.01) |
| ***H04R 1/40*** | (2006.01) |
| ***H04R 3/12*** | (2006.01) |
| ***H04R 1/02*** | (2006.01) |
| ***H04R 1/20*** | (2006.01) |
| ***H04S 7/00*** | (2006.01) |

(52) U.S. Cl.

CPC ..... *H04R 5/02* (2013.01); *H04R 1/026* (2013.01); *H04R 1/20* (2013.01); *H04R 1/403* (2013.01); *H04R 3/12* (2013.01); *H04S 7/303* (2013.01); *H04S 2420/01* (2013.01)

(58) Field of Classification Search

CPC . H04R 5/02; H04R 3/12; H04R 1/403; H04R 1/026; H04R 1/20; H04S 7/303; H04S 2420/01

USPC ..... 381/386

See application file for complete search history.

(56) References Cited

U.S. PATENT DOCUMENTS

| | | | | |
|---|---|---|---|---|
| 5,181,248 | A * | 1/1993 | Inanaga | H04S 1/00 381/310 |
| 5,815,579 | A * | 9/1998 | Boyden | H04R 3/12 381/301 |
| 6,062,337 | A * | 5/2000 | Zinserling | H04R 5/0335 181/129 |
| 6,091,832 | A * | 7/2000 | Shurman | G02C 11/06 2/422 |
| 8,000,486 | B2 * | 8/2011 | Hildebrandt | H04R 1/1075 381/309 |
| 8,121,319 | B2 * | 2/2012 | Azizi | G01S 5/186 381/306 |
| 9,277,343 | B1 * | 3/2016 | Alexandrov | H04S 1/002 |

(Continued)

FOREIGN PATENT DOCUMENTS

EP 3010252 A1 4/2016

*Primary Examiner* — Oyesola C Ojo

(74) *Attorney, Agent, or Firm* — Brooks Kushman P.C.

(57) ABSTRACT

A method for operating a wearable loudspeaker device that is worn on the upper part of the body of a user distant to the user's ears and head comprises determining sensor data, based on the sensor data, and determining at least one parameter related to the current position of the user's head in relation to the wearable loudspeaker device. The method further includes adapting a filter transfer function of at least one filter unit for the current position of the user's head based on the at least one parameter, and an audio output signal that is output to at least one loudspeaker of the wearable loudspeaker device depends on the filter transfer function.

20 Claims, 6 Drawing Sheets

(56) References Cited

U.S. PATENT DOCUMENTS

| | | | | |
|---|---|---|---|---|
| 9,432,793 | B2 * | 8/2016 | Fukui | H04S 1/005 |
| 9,894,326 | B2 * | 2/2018 | Vaziri | G02C 11/10 |
| 2010/0166206 | A1 * | 7/2010 | Macours | G10K 11/178 381/71.6 |
| 2012/0020502 | A1 * | 1/2012 | Adams | H04S 7/304 381/310 |
| 2012/0170779 | A1 * | 7/2012 | Hildebrandt | H04R 1/1075 381/310 |
| 2013/0287224 | A1 * | 10/2013 | Nystrom | H04R 3/005 381/92 |
| 2013/0322667 | A1 * | 12/2013 | Christensen | H04R 5/033 381/309 |
| 2014/0376754 | A1 * | 12/2014 | Banerjea | H04S 3/004 381/311 |
| 2015/0010160 | A1 * | 1/2015 | Udesen | H04R 25/70 381/60 |
| 2015/0326963 | A1 * | 11/2015 | Sorensen | H04R 1/1041 381/74 |
| 2015/0382095 | A1 * | 12/2015 | Shin | H04R 1/1033 242/385.4 |
| 2016/0337747 | A1 * | 11/2016 | Litovsky | H04R 5/0335 |
| 2016/0381453 | A1 * | 12/2016 | Ushakov | H04R 1/1033 381/71.6 |
| 2018/0048976 | A1 * | 2/2018 | Kimura | H04S 7/303 |

* cited by examiner

SYSTEM AND METHOD FOR OPERATING A WEARABLE LOUDSPEAKER DEVICE

CROSS-REFERENCE TO RELATED APPLICATIONS

This application claims foreign priority benefits under 35 U.S.C. § 119(a)-(d) to EP Application Serial No. 16182781.1, filed Aug. 4, 2016, the disclosure of which is hereby incorporated in its entirety by reference herein.

TECHNICAL FIELD

The disclosure relates to a system and a method for operating a wearable loudspeaker device, in particular a wearable loudspeaker device in which the loudspeakers are arranged at a certain distance from the ears of the user.

BACKGROUND

Many people do not like wearing headphones, especially over long periods, because the headphones may cause physical discomfort. For example, headphones may cause permanent pressure on the ear canal or on the pinna as well as fatigue of the muscles supporting the cervical spine. Therefore, wearable loudspeaker devices are known which can be worn around the neck or on the shoulders. Such devices allow high volume levels for the user, while other persons close by experience much lower sound pressure levels. Furthermore, due to the close proximity of the loudspeakers to the ears of the user, room reflections are relatively low. However, while benefiting from several advantages, such wearable devices also suffer from several disadvantages. One major disadvantage, for example, is that the acoustic transfer function between the loudspeakers of the device and the ears of the user varies due to head movement. This results in variable coloration of the acoustic signal as well as a variable spatial representation.

SUMMARY

A method for operating a wearable loudspeaker device that is worn on the upper part of the body of a user distant to the user's ears and head is described. The method includes determining sensor data and determining, based on the sensor data, at least one parameter related to the current position of the user's head. The method further includes adapting a filter transfer function of at least one filter unit for the current position based on the at least one parameter, and an audio output signal that is output to at least one loudspeaker of the wearable loudspeaker device depends on the filter transfer function.

A system for operating a wearable loudspeaker device that is worn on the upper part of the body of a user distant to the user's ears is described. The system includes a first filter unit configured to process an audio input signal and output an audio output signal to at least one loudspeaker of the wearable loudspeaker device and a control unit configured to receive sensor data, determine, based on the sensor data, at least one parameter related to the current position of the user's head in relation to the wearable loudspeaker device. The control unit is further configured to adapt a filter transfer function of the filter unit for the current position of the user's head based on the at least one parameter, and the audio output signal depends on the filter transfer function.

Other systems, methods, features and advantages will be or will become apparent to one with skill in the art upon examination of the following detailed description and figures. It is intended that all such additional systems, methods, features and advantages be included within this description, be within the scope of the invention and be protected by the following claims.

BRIEF DESCRIPTION OF THE DRAWINGS

The method may be better understood with reference to the following description and drawings. The components in the figures are not necessarily to scale, emphasis instead being placed upon illustrating the principles of the invention. Moreover, in the figures, like referenced numerals designate corresponding parts throughout the different views.

FIG. 3, including

DETAILED DESCRIPTION

Figure 1:
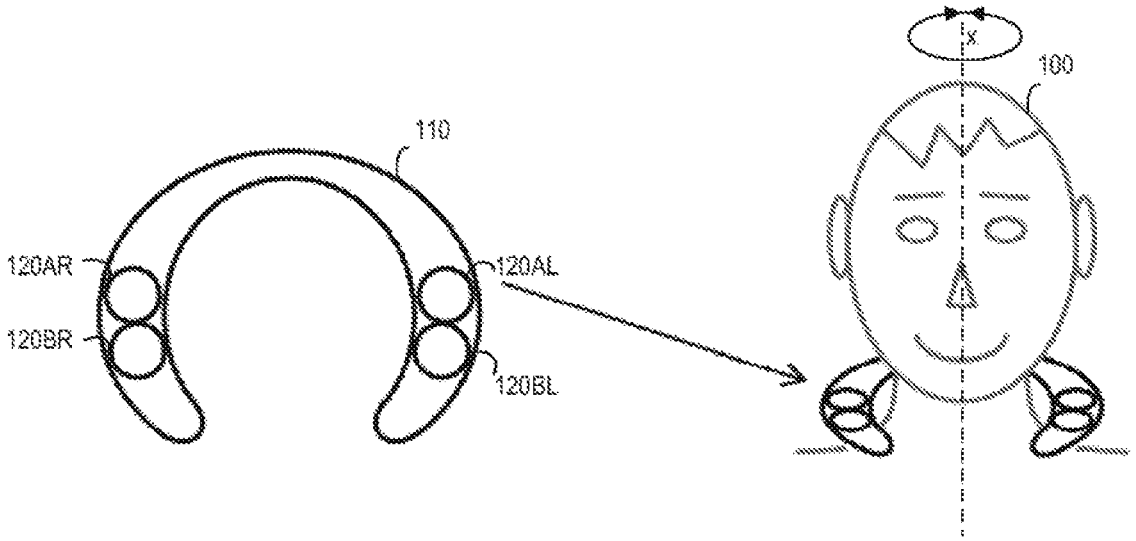
FIG. 1 is a schematic diagram illustrating an exemplary wearable loudspeaker device and a user wearing the wearable loudspeaker device.
Figure 2:
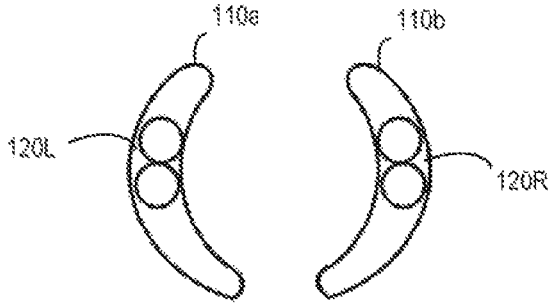
FIG. 2, is a schematic diagram of another exemplary wearable loudspeaker device.

Referring to FIG. 1, a wearable loudspeaker device 110 may be worn around the neck of a user 100. The wearable loudspeaker device 110, therefore, may have a U-shape. Any other shapes, however, are also possible. The wearable loudspeaker device, for example, may be flexible such that it can be brought into any desirable shape. The wearable loudspeaker device 110 may rest on the neck and the shoulders of the user 100. This, however, is only an example. The wearable loudspeaker device 110 may also be configured to only rest on the shoulders of the user 100 or may be clamped around the neck of the user 100 without even touching the shoulders. Any other location or implementation of the wearable loudspeaker device 110 is possible. To allow the wearable loudspeaker device 110 to be located in close proximity of the ears of the user 100, the wearable loudspeaker device 110 may be located anywhere on or close to the neck, chest, back, shoulders, upper arm or any other part of the upper part of the body of the user. Any implementation is possible in order to attach the wearable loudspeaker device 110 in close proximity of the ears of the user 100. For example, the wearable loudspeaker device 110 may be attached to the clothing of the user 100 or strapped to the body by a suitable fixture. Referring to FIG. 1, the wearable loudspeaker device 110 is implemented as one physical unit. As is illustrated in FIG. 2, for example, the wearable loudspeaker device 110 may include two sub-units 110*a*, 110*b*, wherein one unit includes at least one loudspeaker 120L for the left ear and the other unit includes at least one loudspeaker 120R for the right ear. Each unit 110*a*, 110*b* may rest on one shoulder of the user 100. In other embodiments, the wearable loudspeaker device 110 may include even more than two sub-units.

The wearable loudspeaker device 110 may include at least one loudspeaker 120. The wearable loudspeaker device 110, for example, may include two loudspeakers, one loudspeaker for each ear of the user. As is illustrated in FIG. 1, the wearable loudspeaker device 110 may include even more than two loudspeakers 120. For example, the wearable loudspeaker device 110 may include two loudspeakers 120AR, 120BR for the right ear of the user 100 and two loudspeakers 120AL, 120BL for the left ear of the user 100, to enhance the user's listening experience.

Figures 3A, 3B, 3C, 3D:
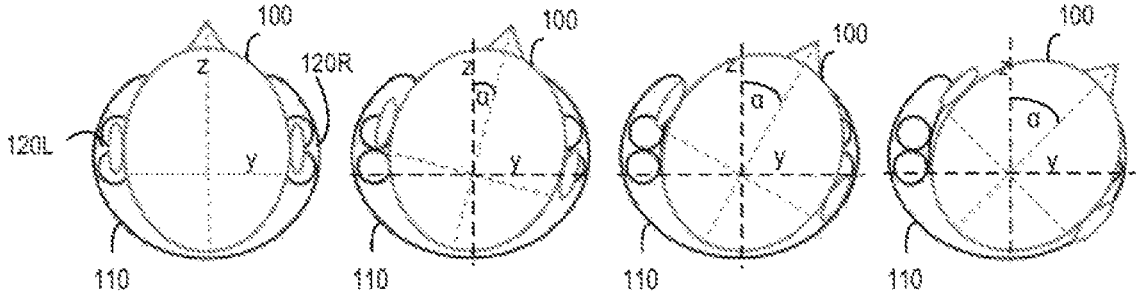
FIGS. 3A-3D, illustrates in schematic diagrams different head postures of a user while wearing a wearable loudspeaker device.

As the wearable loudspeaker device 110 is attached to the neck, shoulder or upper part of the body of the user 100, but distant to the ears of the user 100, the ears of the user 100 might not always be in the same position in relation to the loudspeakers 120 for different postures of the head. This is illustrated in FIG. 3. FIG. 3A illustrates a first posture of the head of the user 100. In this first posture the ears of the user 100 are essentially in one line with the loudspeakers 120R, 120L. This represents a first posture of the user's head with a head rotation angle of 0° around a first axis x. In this posture, the distance between the left loudspeaker 120L and left ear is essentially the same as the distance between the right loudspeaker 120R and right ear. The distance between the ears and the loudspeakers 120R, 120L, however, may change, when the user 100 performs a rotation of his head around the first axis x that is essentially perpendicular to the earth's surface when the user 100 is standing upright. This first axis x and the rotation of the user's head around this first axis x is exemplarily illustrated in FIG. 1. This is, however, only an example. The user 100 may also perform a rotation of the head around a second axis y (e.g. when nodding) or around a third axis z (e.g. when bringing his right ear to his right shoulder) or any combination of rotation around these three axes. A movement of the head may generally cause a rotation around more than one of the mentioned axes. As is illustrated in FIG. 3, the second axis y may be perpendicular to the third axis z and both the second axis y and the third axis z may be perpendicular to the first axis x.

A rotation of the user's head around the first axis x is illustrated in FIGS. 3B, 3C and 3D. In FIG. 3B, the head is rotated by an angle α of 15°, in relation to the initial posture of the head as is illustrated in FIG. 3A. In FIG. 3C a rotation of the head by an angle α of 30° is illustrated and in FIG. 3D a rotation of the head by an angle α of 45° is illustrated. As can clearly be seen, the greater the angle α, the greater the distance between the ears and the respective loudspeakers 120R, 120L. This means that the distance which the sound outputted by the loudspeakers 120R, 120L has to travel increases. In addition, when rotating the head, the position of the ears changes with respect to the main radiation axis of the loudspeakers which typically shows an amplitude response dependency from radiation angle. Furthermore, when rotating the head, the ears may be shadowed to various extents by parts of the user's body (i.e., head, neck, chin or shoulder) which may block the direct path of sound from the loudspeakers 120R, 120L to the ears of the user.

Figure 4:
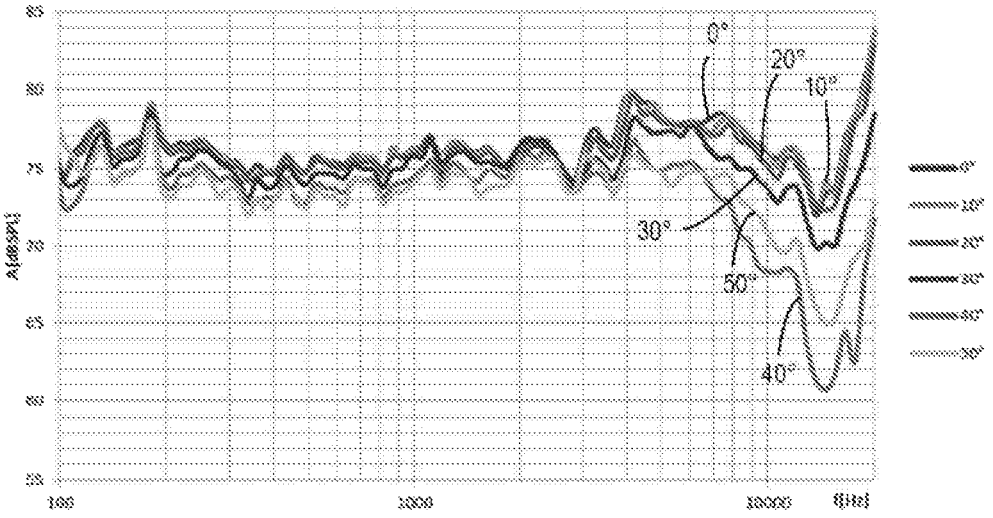
FIG. 4 illustrates in a diagram the amplitude response from a first loudspeaker of a wearable loudspeaker device to the user's left ear for different head postures of the user when performing a rotation to the right.

Therefore, the amplitude and phase response of the loudspeakers 120 of the loudspeaker device 110, measured at the ears of the user 100 varies with the posture of the head. As can be seen in FIG. 4, the amplitude response is different for different rotation angles α of the user's head. FIG. 4 illustrates the amplitude response from the left speaker 120L of a wearable loudspeaker device 110 to the left ear of the user 100 for various frequencies, when the head of the user 100 performs a rotation to the right. A rotation to the right is exemplarily illustrated in FIG. 3. In FIG. 4, a first graph illustrates the amplitude response for a rotation angle α of 0°. This means that the user 100 does not perform any rotation of his head. Further graphs illustrate the amplitude responses for rotation angles α of 10°, 20°, 30°, 40° and 50° for several frequencies. The graphs show that, especially at higher frequencies, the tonality changes when the head is rotated and, furthermore, the wideband sound pressure level is reduced when the head is rotated by more than 30°. It can further be seen that for most frequencies the deviation of the amplitude response increases with an increase of the angle α. Frequency dependent deviations extend down to 2 kHz and strongly affect the tonality. Wideband sound pressure reductions of 3 dB or more as illustrated in FIG. 4 will usually be recognized by the average user.

Figure 5:
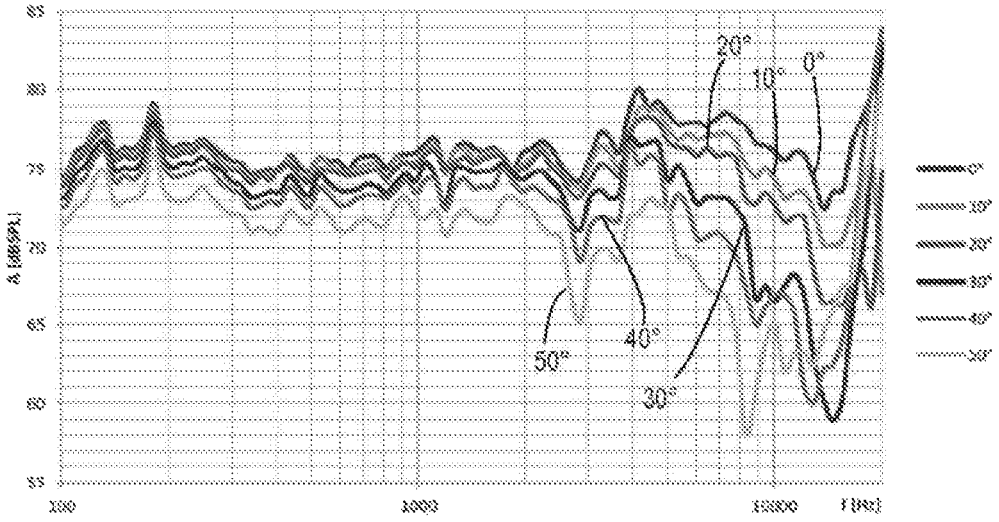
FIG. 5 illustrates in a diagram the amplitude response from a first loudspeaker of a wearable loudspeaker device to the user's left ear for different postures of the user's head when performing a rotation to the left.
Figure 6:
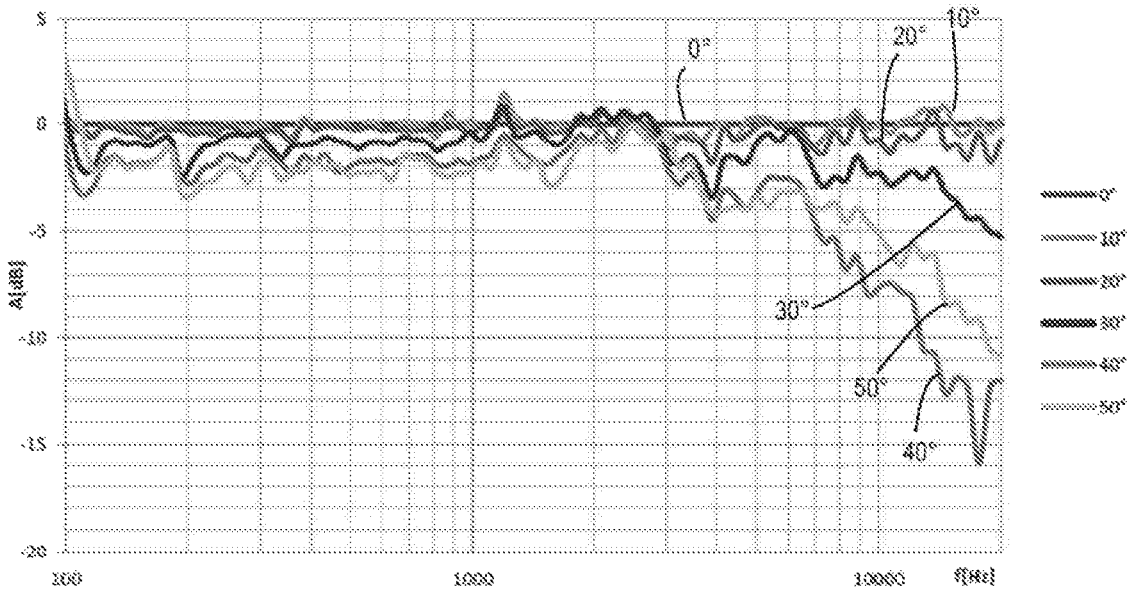
FIG. 6 illustrates in a diagram the amplitude response from a first loudspeaker of a wearable loudspeaker device to the user's left ear, referenced to the amplitude response at an initial posture of the user's head, for different postures of the user's head when performing a rotation to the right.
Figure 7:
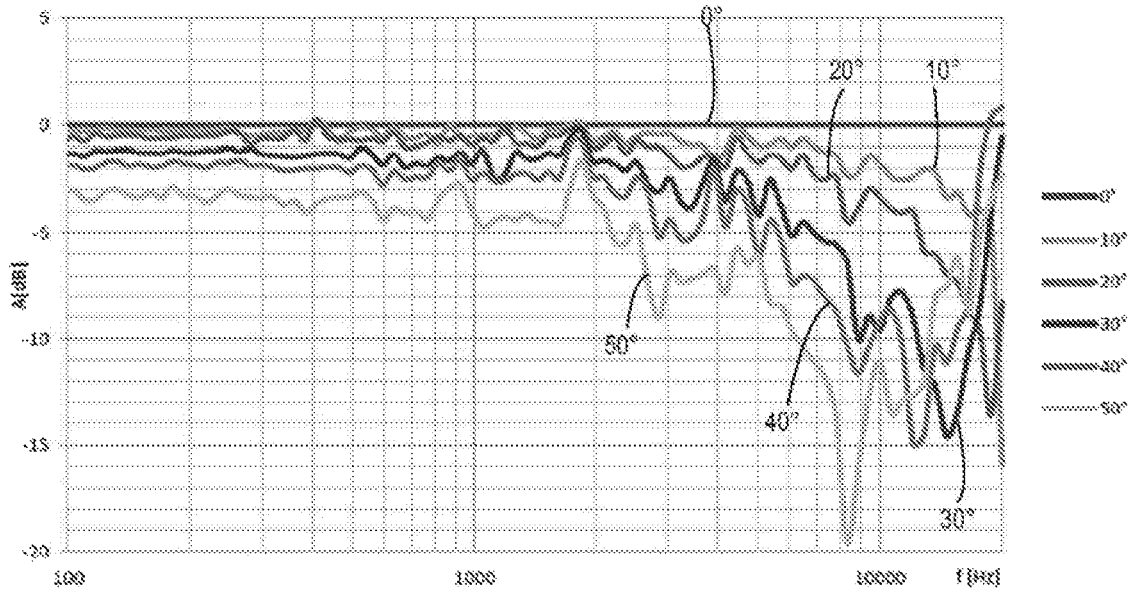
FIG. 7 illustrates in a diagram the amplitude response from a first loudspeaker of a wearable loudspeaker device to the user's left ear, referenced to the amplitude response at an initial posture of the user's head, for different postures of the user's head when performing a rotation to the left.

The same results can be seen from FIG. 5, which illustrates the amplitude response from the left speaker 120L of a wearable loudspeaker device 110 to the left ear of the user 100, when the head of the user 100 performs a rotation to the left. FIG. 6 illustrates the amplitude response from the left speaker 120L of a wearable loudspeaker device 110 to the left ear of the user 100, when the head of the user 100 performs a rotation to the right, wherein the measurements for angles α>0° are referenced to the measurement at α=0°. FIG. 7 illustrates the amplitude response from the left speaker 120L of a wearable loudspeaker device 110 to the left ear of the user 100, when the head of the user 100 performs a rotation to the left, wherein the measurements for angles α>0° are referenced to the measurement at α=0°.

The amplitude response variations as illustrated by means of FIGS. 4-7 considerably impair the sound quality for normal stereo playback even for moderate head rotations. Furthermore, surround or even 3D audio playback, as known from binaural recording played over headphones, for example, considerably suffer from variable transfer functions between loudspeaker device and ears because the spatial cues are altered by amplitude and phase variations.

While in FIGS. 4-7 the amplitude response is illustrated for the left ear and left speaker 120L only, similar results may be obtained for the right ear and right speaker 120R when the head of the user 100 performs a rotation to the left or the right. Further, FIGS. 4-7 only illustrate the amplitude response for a rotation of the head around the first axis x. Similar results, however, would be obtained for head rotations around the second axis y, the third axis z or any combination of rotations around these axes. FIGS. 4-7 just aim to generally illustrate the effect of head movement.

When using headphones, the loudspeaker 120 to ear transfer function is usually constant, irrespective of the posture of the user's head, because the headphones move together with the ears of the user 100 and the distance between the loudspeakers 120 and the ears as well as the mutual orientation stay essentially constant. For the wearable loudspeaker devices 110 which do not follow the head movement of the user 100, it may be desirable to achieve a similar situation, meaning that the user 100 does not notice considerable differences in tonality and loudness when moving his head. In addition to head movement, also the wearable device 110 itself may not always be in the same position. Due to movements of the user 100, for example, the wearable loudspeaker device 110 may shift out of its original place. To at least reduce perceivable differences in tonality and loudness, transfer function variations may be dynamically compensated at least partially depending on head movement.

Figure 8:
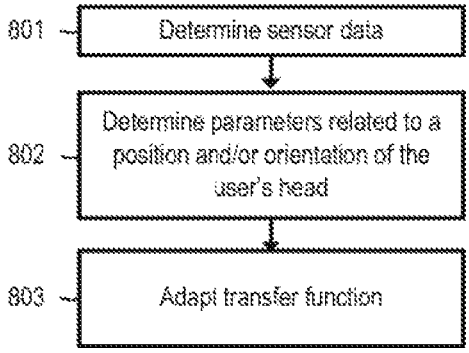
FIG. 8 illustrates in a flow chart a method for operating a wearable loudspeaker device.

FIG. 8 illustrates in a flow chart a method for operating a wearable loudspeaker device 110, in particular by dynamically adapting a transfer function of the loudspeaker device. First, sensor data of at least one sensor may be determined (step 801). The sensor data depends on the posture, orientation and/or position of the user's head and optionally also on the orientation and position of the loudspeaker device. The sensor data may depend on the position of the user's head in relation to the wearable loudspeaker device 110 or the loudspeakers 120L, 120R of the wearable loudspeaker device 110, for example. The sensor data may also depend on the positions of the user's head and the wearable loudspeaker device 110 in relation to a reference spot distant to the user and the wearable loudspeaker device 110. In a next step, at least one parameter is determined from the sensor data which is related to the orientation and/or position of the user's head relative to the wearable loudspeaker device 110 or the loudspeakers 120L, 120R of the wearable loudspeaker device 110 (step 802). The at least one parameter, for example, may include a rotation angle about a first axis x, a second axis y, a third axis z or any other axis. However, these are only examples. The at least one parameter may include any other parameter that is related to the position of the user's head. Depending on what kind of sensor is used, the at least one parameter may alternatively or additionally include a run-time, a voltage or one or more pixels, for example. Any other suitable parameters are also possible. The at least one parameter may alternatively or additionally include abstract numbers without geometrical or physical meaning. Based on the one or more parameters, a transfer function of the loudspeaker device may be adapted (step 803). The method will now be described in more detail.

To determine sensor data that depends on the position of the user's head, one or more sensors may be used, for example. The one or more sensors may include orientation sensors, gesture sensors, proximity sensors, image sensors, or acoustic sensors. These are, however, only examples. Any other sensor types may be used that are suitable to determine sensor data that depends on the position of the user's head. Orientation sensors among others, may include (geomagnetic) magnetometers, accelerometers, gyroscopes, or gravity sensors. Gesture or proximity sensors, among others, may include infrared sensors, electric near field sensors, radar based sensors, thermal sensors, or ultrasound sensors. Image sensors may include sensors such as video sensors, time-of-flight cameras, or structural light scanners, for example. Acoustic sensors may include microphones, for example. These are, however, only examples.

At least one sensor may be integrated in or attached to the wearable loudspeaker device 110, for example. The sensor data may depend on the posture of the user's head or on the position of the user's head in relation to the wearable loudspeaker device 110. For example, at least one gesture or proximity sensor may be arranged on the wearable loudspeaker device 110 and may be configured to provide sensor data that depends on the distance between parts of the user's head (e.g. the user's ears, chin and/or parts of the neck) and the respective sensor. In one embodiment, distance sensors are arranged at two distal ends of the wearable loudspeaker device 110 which are, for example, arranged close to the chin at approximately symmetrical positions with respect to the median plane, to detect the distance between the respective sensor and objects (e.g. the user's chin and/or parts of the user's neck) in areas near the sensor. When the user turns his head to one side, his chin and/or parts of the neck, for example, may move closer to at least one of the sensors and further away from at least another one of the sensors. Therefore, the sensor data that is detected by the respective sensors will be affected by this movement in an approximately opposing manner. Furthermore, if the user turns his head up or down, the distance between parts of his head (e.g. his chin and/or parts of the neck) and the sensors at each distal end of the wearable loudspeaker device 110 may increase or decrease approximately equally and, therefore, affect the sensor data of the sensors at each distal end in an approximately equal manner.

It is, however, also possible that at least one sensor is mounted on each of the wearable loudspeaker device 110, the user, or on a second device attached to the user. Generally, the position of the sensors may depend on the kind of sensor that is used. For example, at least one sensor may be mounted close to the loudspeakers 120L, 120R of the wearable loudspeaker device 110 or at any other position on the wearable loudspeaker device for which the geometrical relation to at least one of the loudspeakers 120L, 120R is fixed. At least one sensor may be attached to the user's body instead of or in addition to the at least one sensor attached to the wearable loudspeaker device 110. The at least one sensor attached to the user's body may be attached to the user's head in any suitable way. For example, a sensor may be attached to or integrated in glasses that the user 100 is wearing (e.g. shutter glasses as used for 3D TV or virtual reality headsets). The sensor may also be integrated in or attached to earrings, an Alice band, a hair tie, a hairslide, or any other devices that the user 100 might be wearing or that is attached to his head. By means of the sensors, sensor data may be determined that is dependent on the position of the user's head and the wearable loudspeaker device 110. For example, orientation sensors may be attached to the wearable loudspeaker device 110 and on the user's head. Such orientation sensors may, for example, provide sensor data that depends on the position of the respective sensors with respect to a third position (e.g., north pole, center of earth gravity or any other reference point). The correlation of such sensor data from the wearable loudspeaker device 110 and the user's head may depend on the position of the user's head in relation to the wearable loudspeaker device 110 or in relation to the loudspeakers 120L, 120R of the wearable loudspeaker device 110.

In another example, at least one microphone may be attached to the user's head while no sensors are attached to the wearable loudspeaker device 110. The at least one microphone is configured to sense acoustic sound pressure that is generated by at least one loudspeaker of the wearable loudspeaker device 110, as well as acoustic sound pressure that is generated by other sound sources. The time of arrival and/or the sound pressure level of the sound at the at least one microphone that is radiated by at least one loudspeaker of the wearable loudspeaker device, generally depend on the relative position of the user's head and the wearable loudspeaker device 110. For example, the wearable loudspeaker device 110 may radiate certain trigger signals over one or more of the loudspeakers. A trigger signal, for example, may be a pulsed signal that includes only frequencies that are inaudible to humans (e.g., above 20 kHz). The time of reception and/or sound pressure level of such trigger signals that are radiated by one or more loudspeakers 120 of the wearable loudspeaker device 110 and sensed by the at least one microphone, may depend on the posture of the user's head or the position of the user's head in relation to the wearable loudspeaker device 110. It is not necessarily required to determine the actual posture of the user's head that is related to a certain determined value of the sensor data or a set of values of the sensor data. Instead it is sufficient to know the required transfer function or adaption of transfer function that is related to certain sensor data.

It is also possible that alternatively or additionally to the previously described sensors at least one sensor is arranged distant to the user 100 and to the wearable loudspeaker device 110. For example, a remote sensor unit may be arranged at a certain distance from the user 100. The remote sensor unit, for example, may be integrated in a TV or an audio unit, especially an audio unit that sends audio data to the wearable loudspeaker device 110. Such a remote sensor unit may include image sensors, for example. However, alternatively or additionally it may include orientation sensors, gesture sensors or proximity sensors, for example. When using such a remote sensor unit, further sensors that are positioned on the user's head or on the wearable loudspeaker device 110 are not necessarily required. Sensor data that is dependent on the posture of the user's head or the position of the user's head in relation to the wearable loudspeaker device 110 or in relation to the remote sensor unit may be determined. Furthermore, sensor data that depends on the position and/or the orientation of the wearable loudspeaker device 110 in relation to the remote sensor unit may be determined. In one example, the remote sensor unit includes a camera. The camera may be configured to take pictures of the user's head and upper body and thus provide sensor data dependent on the posture of the user's head. With the use of suitable software or face recognition algorithms, for example, at least one parameter which is related to the posture, position of the user's head may then be determined. This is, however, only one example. There are many other ways to determine at least one parameter which is related to the posture, position of the user's head using a sensor unit that is arranged distant to the user 100.

It is also possible that the sensor unit that is arranged distant to the user 100 provides sensor data that is dependent on the position of at least one sensor positioned on the user's head and/or on the wearable loudspeaker device 110. From the sensor data, at least one parameter may be determined which is related to the position of the user's head. At least one sensor may be arranged on the user's head in any way, as has already been described above. Further sensors may be integrated in or attached to the wearable loudspeaker device 110. Any combination of sensors is possible that allows a determination of sensor data from which at least one parameter which is related to the position of the user's head and/or the wearable loudspeaker device 110 may be determined.

From the sensor data acquired by the at least one sensor, for which multiple examples are given above, at least one parameter may be determined which is related to the position of the user's head. The at least one parameter may define the position of the user's head in relation to the wearable loudspeaker device 110 with suitable accuracy. The at least one parameter may at least relate to a certain position such that certain parameter values or ranges of parameter values at least approximately correspond to certain positions of the user's head or certain ranges of positions of the user's head. The parameter, for example, may be a rotation angle relative to an initial position of the user's head. The initial position may be a position in which the user 100 is looking straight forward. The ears of the user 100 in this position may be essentially in one line with the left and the right loudspeaker 120L, 120R of the wearable loudspeaker device 110. The initial position, therefore, corresponds to a rotation angle of 0°. The rotation may be performed around any axis, as has already been described above. When a rotation is performed around more than one axis, the position of the user's head may be described by means of more than one rotation angle. However, according to one embodiment, tracking of the user's head movements may also be restricted to movements around a single axis, thereby ignoring movements around other axes. Any other parameters may be used to describe the position of the user's head alternatively or in addition to the at least one rotation angle. For example, a distance between the left loudspeaker 120L and the left ear and a distance between the right loudspeaker 120R and the right ear might be indicative for the position of the user's head. The at least one parameter may also be an abstract parameter in such a way that certain parameter value ranges relate to certain positions of the user's head, but have no geometrical meaning. The parameter may, for example, have a physical meaning (e.g. voltage or time) or a logical meaning (e.g. index of a look-up table). Furthermore, any position of the user's head or, more generally speaking, any parameter value, combination of parameter values, parameter value range or combination of parameter value ranges dependent thereof, may be defined as the initial position, initial parameter value, initial combination of parameter values, initial parameter value range or initial combination of parameter value ranges. For example, the user looking to the right, to the left, up or down may be defined as the initial or reference position and/or orientation. More generally speaking, any set of parameter values may be defined as the initial or reference set of parameter values.

Figure 9:
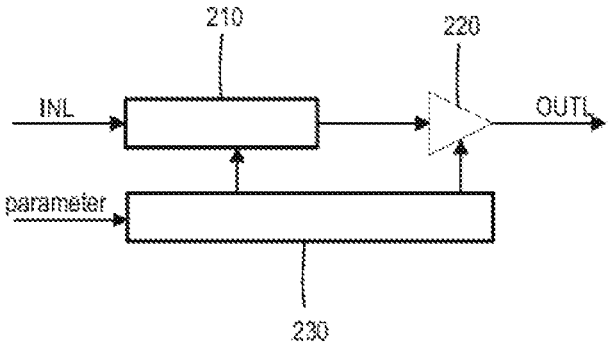
FIG. 9 illustrates in a block diagram a system for operating a wearable loudspeaker device.

FIG. 9 illustrates a system for operating a wearable loudspeaker device 110. The system may be included in the wearable loudspeaker device 110 or in an external device. The system may include a filter unit 210, a gain unit 220 and a control unit 230. The filter unit 210 may include an adaptive filter and may be configured to process an audio input signal INL and to output an audio output signal OUTL. To process the audio input signal INL, the transfer function of the filter unit 210, and more specifically the transfer function of the adaptive filter, may be adapted. When the user's head is in the initial position, a first filter transfer function may be used to process the audio input signal INL to offer an intended listening experience to the user 100. Alternatively, the transfer function at this initial position may equal 1 (H(s)=1), as static equalizing, which is usually done by filters with constant transfer functions in order to adapt the transfer function of the loudspeakers for the intended listening experience, may be done by filters that are independent of the system of FIG. 9. When the user 100 moves his head, a different filter transfer function or compensation transfer function may be required to allow for a constant listening experience. Therefore, a transfer function compensation may be performed, which means that the filter transfer function may be adapted depending on the position of the user's head. Therefore, the control unit 230 may receive an input signal which represents the at least one parameter related to the current position of the user's head. Based on the at least one parameter, the control unit 230 may control the filter transfer function of the filter unit 210.

The gain unit 220 is configured to adapt the level of the audio output signal OUTL. Optionally, also the gain or attenuation of the gain unit 220 may be adapted depending on the current position of the user's head. This, however, might not be necessary for every position of the user's head or might be included in the transfer function of the adaptive filter and, therefore, is optional. Therefore, the transfer function of the filter unit 210 and, optionally, the gain of the gain unit 220 may compensate at least partially for any variations of sound caused by movements of the user's head. To compensate such variations, an exact or approximate inverse transfer function may be applied, for example. This inverse transfer function for any position of the user's head which is not the initial position may, for example, be determined from the differences in amplitude and/or phase response of at least one loudspeaker of the wearable loudspeaker device measured at at least one ear of the user between the initial position or initial set of parameter values and the position of the user's head which is not the initial position or a set of parameter values defining this position. Subsequently, the control unit 230 adapts the filter transfer function of the filter unit 210 and (optionally) the gain or attenuation of the gain unit 220 to generate an appropriate audio output signal OUTL to allow a constant listening experience, irrespective of the user's head position.

One possibility for choosing a filter transfer function and a gain for a certain parameter related to a certain position of the user's head is to use look-up tables. A look-up table may include pre-defined filter control parameters and/or gain values for multiple rotation angles or angle combinations or any other values or value combinations of the at least one parameter related to the position of the user's head. A look-up table might not cover all possible angles, angle combinations, parameter values or combinations of parameter values. Therefore, transfer functions for intermediate angles, parameters, combinations of angles or combinations of parameters which fall in between angles or parameters that are listed in the look-up table may be interpolated by any suitable method. For example, filter control parameters (e.g. frequency, gain, quality of analogue or IIR filters) or coefficients (e.g. of IIR or FIR filters) may be interpolated. Several interpolation methods are generally known and, therefore, will not be discussed in greater detail. Filter control parameters that are listed in the look-up table may be coefficients of the filter unit 210 that allow for controlling the filter unit 210. The filter unit 210 may, for example, include a digital filter of the IIR or FIR type. Other filter types, however, are also possible.

The filter unit 210 may include an analogue filter, for example. The analogue filter may be controlled by a control voltage. The control voltage may determine the transfer function of the filter. This means, by changing the control voltage, the transfer function may be adapted. When the filter unit 210 includes an analogue filter, the look-up table may include control voltages that are linked to several rotation angles, rotation angle combinations, values or combinations of values for the at least one parameter related to the position of the user's head. A certain control voltage may then be applied for each determined parameter related to a position of the user's head. Therefore, the control unit 230 may include a digital-to-analog converter to provide the desired control voltage. The filter unit 210 may be implemented in the frequency domain. If implemented in the frequency domain, the filter control parameters may include multiplication factors for individual frequency spectrum components.

Generally, however, the filter transfer function may be controlled in any possible way. The exact implementation may depend on the filter type that is used within the filter unit 210. If IIR or FIR filters are used, the filter coefficients as well as multiplication factors that may be used for individual frequency spectrum components may be set to different values depending on the at least one parameter related to the position of the user's head in order to set the desired transfer function.

In the system that is illustrated in FIG. 9, an audio output signal OUTL for the left loudspeaker 120L is provided. This is, however, only an example. The system may also be used to provide an audio output signal OUTR for the right loudspeaker 120R. Many of these systems may be used to provide output signals for multiple loudspeakers.

Figure 10:
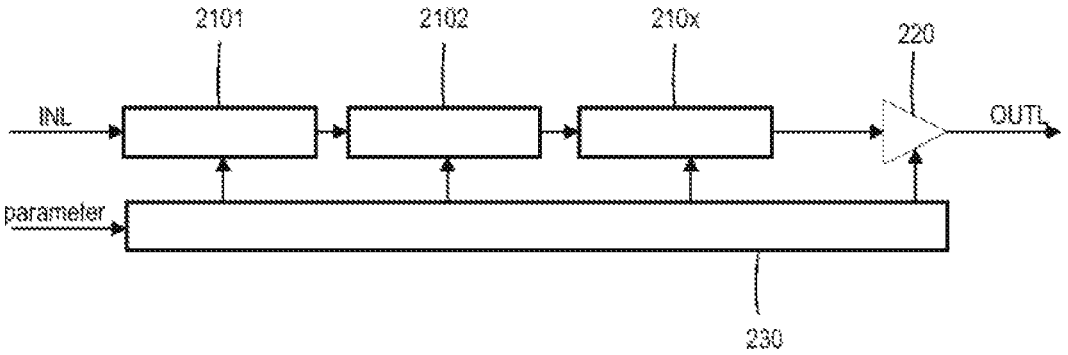
FIG. 10 illustrates in a block diagram a further system for operating a wearable loudspeaker device.

The system illustrated in FIG. 9 includes only one filter unit 210. As is illustrated in FIG. 10, other systems may include more than one filter unit coupled in series. The system in FIG. 10 includes a first filter unit 2101, a second filter unit 2102 and a third filter unit 210*x*. All filter units 2101, 2102, 210*x* are controlled by the control unit 230. More than one filter unit 2101, 2102, 210*x* may be used, for example, when the filter units 2101, 2102, 210*x* include analog filters or IIR filters. In such cases, multiple filter units 2101, 2102, 210*x* coupled in series may lead to more accurate transfer functions. However, more than one filter unit 2101, 2102, 210*x* may also be used in any other case.

Figure 11:
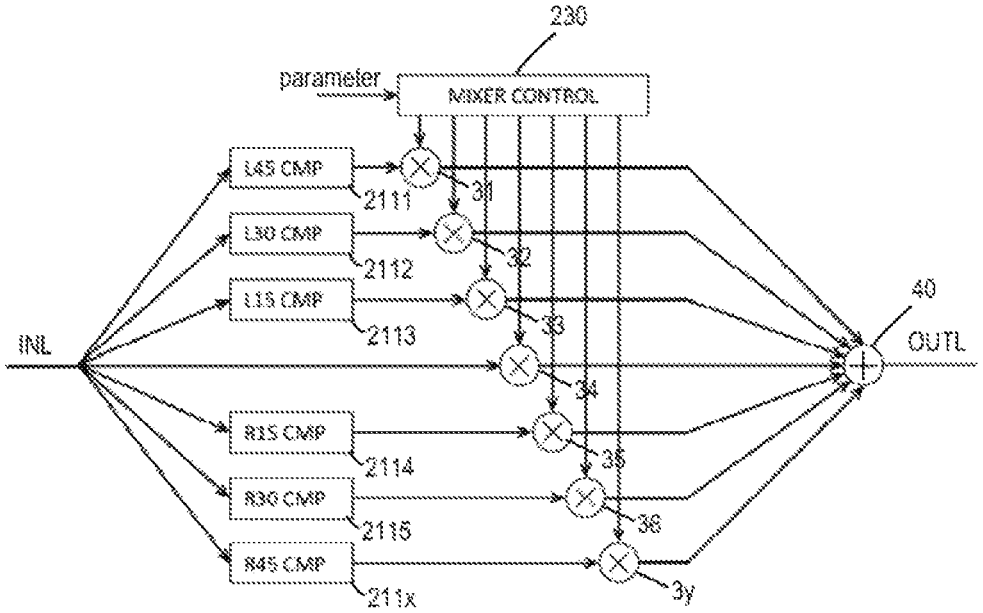
FIG. 11 illustrates in a block diagram a further system for operating a wearable loudspeaker device.

FIG. 11 illustrates another system for operating a wearable loudspeaker device 110. In this system several filter units 2111, 2112, 2113, . . . , 211*x* are coupled in parallel. The system in FIG. 11 includes six filter units 2111, 2112, 2113, . . . ,211*x*. However, this is only an example. Any number of filter units 2111, 2112, 2113, . . . , 211*x* may be coupled in parallel. A first filter unit 2111 may include a compensation filter for a rotation angle of 45° to the left around the first axis x. A second filter unit 2112 may include a compensation filter for a rotation angle of 30° to the left and a third filter unit 2113 may include a compensation filter for a rotation angle of 15° to the left. A fourth, fifth and sixth filter unit 2114, 2115, 2116 may include compensation filters for rotation angles of, respectively, 15°, 30° and 45° to the right. This is, however, only an example. The filter units 2111, 2112, 2113, . . . ,211*x* may include compensation filters for any other rotation angles or, more generally speaking, for any values or value combinations of the at least one parameter related to the position of the user's head. One multiplication unit 31, 32, 33, 34, 35,3*x* is coupled in series to each filter unit 2111, 2112, 2113, . . . ,211*x*, respectively. Based on the position of the user's head, which is represented, for example, by the rotation angle around the first axis x or, more generally speaking, any value or value combinations of the at least one parameter related to the position of the user's head, the control unit may determine a weighting gain value that is applied to (multiplied with) the filter unit outputs. After applying a weighting gain value to each of the filter outputs, all weighted filter outputs may be applied to an adder 40 to generate the audio output signal OUTL as the sum of all filter unit outputs. This allows for an interpolation between the compensation filters to receive satisfactory results also for intermediate angles.

Figure 12:
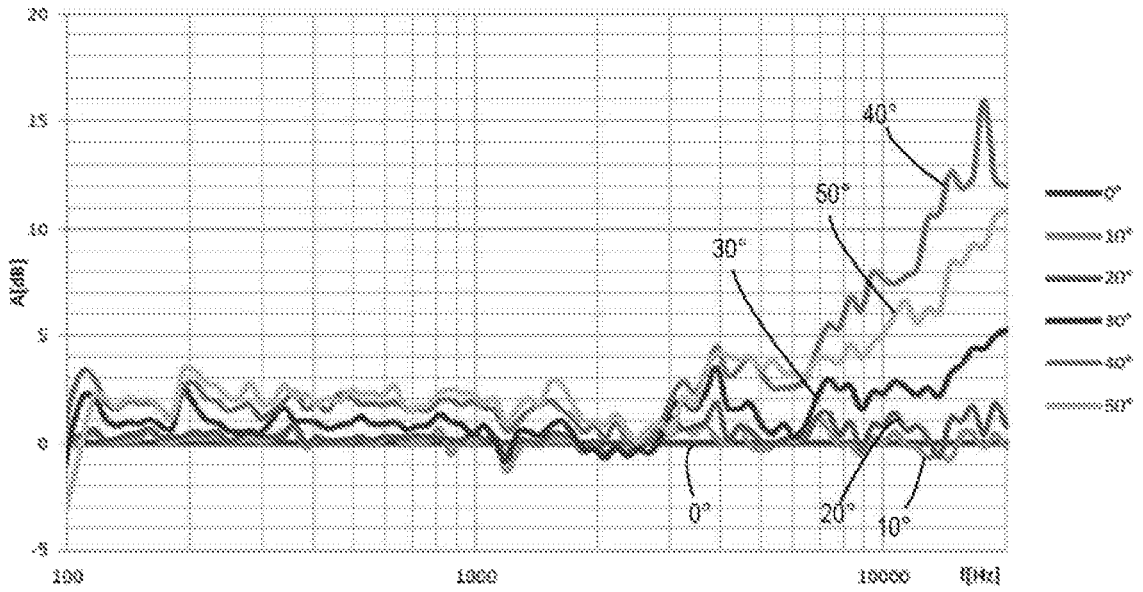
FIG. 12 illustrates in a diagram the amplitude function of a compensation filter for different postures of the user's head when performing a rotation to the right.
Figure 13:
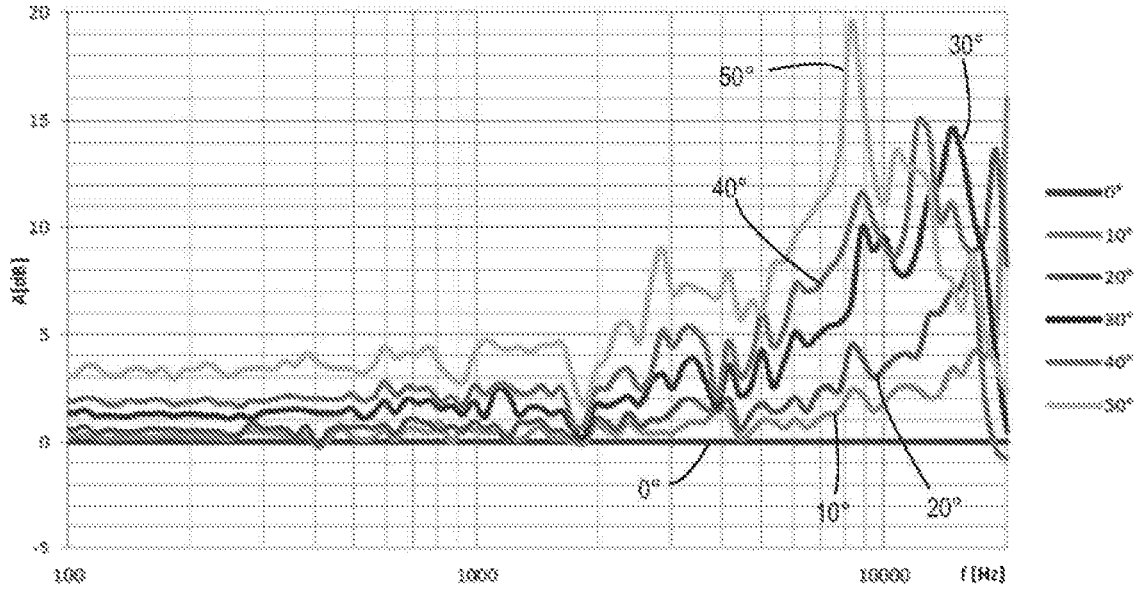
FIG. 13 illustrates in a diagram the amplitude function of a compensation filter for different postures of the user's head when performing a rotation to the left.

The transfer functions of the at least one filter unit 210 may be determined from amplitude and/or phase response measurements performed for all possible positions of the user's head or a subset thereof and/or all possible rotation angles around at least one axis in relation to an initial position and/or rotation angle or a subset thereof (see FIGS. 4-7). The amplitude and/or phase response measurements may include any loudspeaker of the wearable loudspeaker device and/or the acoustic path to any ear of the user and optionally the transfer function of the outer ear (pinna) of the user. Measurements may, for example, also be carried out with a dummy head resembling human anatomy to certain extents. Such a dummy head may, for example, include a detailed or simplified pinna or may not include any pinna at all. Neglecting the transfer function of the outer ear in the amplitude and/or phase measurements may reduce unwanted tonal colorations or localization shifts caused by the resulting filter transfer functions. FIG. 12 illustrates possible compensation functions for the left speaker 120L of a wearable loudspeaker device 110 for rotation angles to the left around the first axis x of 10°, 20°, 30°, 40° and 50°, in reference to the transfer function for a rotation angle of 0°. FIG. 13 illustrates the compensation functions for the left speaker 120L of a wearable loudspeaker device 110 for rotation angles to the right around the first axis x of 10°, 20°, 30°, 40° and 50°, in reference to the transfer function for a rotation angle of 0°.

Alternatively or additionally to compensation of any amplitude variations, also phase or group delay variations caused by head movement may be compensated, for example, at least partially. To achieve this, the at least one filter unit 210 may include an FIR filter of a suitable length with variable transfer functions or variable delay lines, for example, which may be implemented in the frequency or time domain. Group delay compensation may help keep the spatial representation of the wearable loudspeaker device 110 stable, as it avoids a destruction of spatial cues in the phase relation of the signals for the left ear and the right ear.

Generally, human anatomy varies considerably between individuals. Therefore, the listening experience may be different for different users of a wearable device 110. Therefore, the system may be configured to be calibrated for the individual user. A calibration step, calibration process or calibration routine may be performed prior to and independent of the primary use (i.e. playback of acoustic content for listening purpose) of the wearable loudspeaker device 110. In particular, during a calibration step, process or routine the transfer functions for the filter units may be determined for and aligned with the sensor data or the at least one parameter related to the position of the user's head determined from the sensor data for various head positions. Thereby, both, the transfer functions for the filter units and the sensor data or the at least one parameter related to the position of the user's head determined from the sensor data may be calibrated simultaneously for the individual user. The user may turn his head in various directions. For several head positions the sensor output as well as the transfer function from (and possibly including) the loudspeakers of the wearable loudspeaker device to the ears of the user may be determined. The user may turn his head in defined steps. For example, measurements may be performed at head rotation angles of 15°, 30° and 45° to each side (left and right). This, however, may be rather difficult to realize because the user might not know exactly the degree of his head rotation. It is also possible that the user turns his head slowly to both sides. While the user slowly rotates his head, several measurements may be performed continuously. During such measurements, sensor data and associated transfer functions may be acquired. Afterwards, certain values of sensor data may be chosen as sampling points that are included in a look-up table. The values may be chosen such that a change of the transfer function between the sampling points is constant or at least similar. In this way, an approximately constant resolution of the change of transfer function may be obtained for the whole range of motion of the user's head, without having to know the whole range of motion or the actual postures of the user's head related to the sampling points.

The movement of the user's head does not necessarily have to be performed at a constant speed. It is also possible that the user performs the movement at a varying speed or that his head remains at a certain position for a certain time. As the speed of movement relates to the change of the acquired transfer function in such a way that the transfer function does not change if the position of the user does not change and the transfer function changes with a certain rate of change for slow head movement and a higher rate of change for fast head movement over the same range of movement, variations in speed of movement are irrelevant for the previously described way of choosing sampling points to be used for the look-up table. The step size between the sampling points regarding actual head movement does not necessarily need to be constant. As a result of the previously described way of choosing sampling points, step size of head movement between sampling points may instead be variable over the total range of movement. Actual sensor data may have an arbitrary relation to the previously described sampling points. As an example, five sampling points may be chosen. The sampling points may be numbered 1, 2, 3, 4, and 5, whereby the sampling points may, for example, associate to sensor output voltage as exemplary sensor data as 1=1V, 2=1.3V, 3=2V, 4=5V and 5=8V The numbering (1, 2, 3, 4, 5) of the sampling points may be seen as the at least one parameter related to the position of the user's head. In the given example, there is a nonlinear relation between the value of the sampling point numbers and the sensor data. Intermediate sampling points may be calculated for intermediate sensor data values by means of interpolation, resulting in fractional sampling point number values. For example, whole (or integer) sampling point numbers may be chosen as look-up table indices. Certain transfer functions or control parameters for a filter unit, resulting in certain transfer functions of that filter unit, may be associated with every index. By means of interpolation between filter control parameters at the integer look-up table indices, a corresponding set of filter control parameters may be determined for any intermediate sampling point.

In-ear microphones may be used to record an acoustic signal radiated by one or more loudspeakers of the wearable device in order to determine the transfer function from the loudspeakers device, including the loudspeakers to the ears of the user, for example. The in-ear microphones may, for example, be connected to the wearable loudspeaker device for the latter to receive and record the microphone signal. The in-ear microphone may be configured to deliberately capture or suppress cancellation and resonance magnification effects produced by the pinnae of the user (referred to as pinna resonances below). For example, the in-ear microphones may be small in size to only cover or block the entrance of the ear canal in order to include the pinna resonances. In another example, the in-ear microphone or, more specifically, a support structure around the in-ear microphones may be designed to occlude parts of the pinna (e.g. the concha) at least partially to suppress the corresponding pinna resonances. This may exclude monaural directional cues as generated by the user's pinnae from the measured transfer functions for different head positions. Pinna resonances may also be suppressed by appropriate smoothing of the amplitude responses obtained through the previously described measurements. Using the way described above, individual transfer functions can be determined which can be linked to specific sensor outputs (as related to head positions). These transfer functions may be used as a basis for determining the filter transfer functions for specific head positions.

The previously described calibration process may be performed by the intended end user of the wearable loudspeaker device who may wear in-ear microphones during the calibration process. It is, however, also possible, that not the end user himself performs the measurements, but that measurements are performed before selling the wearable loudspeaker devices. A test person may wear in-ear microphones and perform the measurements. The settings may then be the same for several or all wearable loudspeaker devices on the market. Instead of a test person or the user, a dummy head may be used to perform the measurements. The in-ear microphones may then be attached to the dummy head. It is, however, also possible to use head and torso simulators wearing the wearable loudspeaker device and the in-ear microphones. Dummy heads or head and torso simulators may not possess structures that model the human outer ear. In such cases, microphones may be placed anywhere near the typical ear locations.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

What is claimed is:

1. A method for operating a wearable loudspeaker device, the method comprising:

determining sensor data;

based on the sensor data, determining at least one parameter, related to a current position of a user's head in relation to the wearable loudspeaker device that is worn on an upper part of a body of the user distant to the user's ears and head; and adapting a filter transfer function of at least one filter unit for the current position of the user's head based on the at least one parameter, wherein an audio output signal that is output to at least one loudspeaker of the wearable loudspeaker device depends on the filter transfer function, wherein as the user moves his/her head, the user's ears move along with the user's head and a distance between the wearable loudspeaker device and the user's ears changes.

2. The method of claim 1, wherein adapting the filter transfer function of the at least one filter unit comprises compensating at least partly for variations of a transfer function between the at least one loudspeaker of the wearable loudspeaker device and at least one ear of the user for various positions of the user's head in relation to the wearable loudspeaker device by employing an exact or approximate inverse transfer function for any position of the user's head which is not an initial position.

3. The method of claim 1, wherein the at least one parameter related to the current position of the user's head in relation to the wearable loudspeaker device is determined based on data acquired from at least one sensor located at one or more of:

the wearable loudspeaker device;

a second device attached to the user's head; and a third device remote to the user and to the wearable loudspeaker device.

4. The method of claim 3, wherein the sensor data is dependent on at least one of the current position of the user's head in relation to the wearable loudspeaker device;

a position of the user's head in relation to the third device; and a position of the wearable loudspeaker device in relation to the third device.

5. The method of claim 1, wherein:

adapting the filter transfer function of the at least one filter unit comprises adapting control parameters of the at least one filter unit, wherein the filter transfer function is dependent on a value of at least one control parameter.

6. The method of claim 5, wherein:

the control parameters resulting in certain transfer functions of the at least one filter unit are pre-determined prior to or independent of a primary use of the wearable loudspeaker device for multiple values or value ranges or combinations of values or value ranges of the at least one parameter related to the current position of the user's head in relation to the wearable loudspeaker device; and at least one pre-determined control parameter is applied to the at least one filter unit during an intended use of the wearable loudspeaker device in accordance with a current value or combination of values of the at least one parameter related to the current position of the user's head in relation to the wearable loudspeaker device.

7. The method of claim 6, wherein pre-determining the control parameters comprises performing transfer function measurements and wherein performing transfer function measurements comprises:

using microphones for recording an acoustic signal radiated by one or more loudspeakers of the wearable loudspeaker device, and determining the transfer function from the one or more loudspeakers of the wearable loudspeaker device to the microphones, wherein the microphones are located:

in the ears or on the head of a test person, in the ears or on the head of an end user, in the ears of or on a dummy head, or in the ears of or on a head and torso simulator.

8. A system for operating a wearable loudspeaker device, the system comprising:

a first filter unit configured to process an audio input signal and output an audio output signal to at least one loudspeaker of the wearable loudspeaker device; and a control unit configured to receive sensor data;

based on the sensor data, determine at least one parameter related to a current position of a user's head in relation to the wearable loudspeaker device that is worn on an upper part of a body of the user distant to the user's ears and head; and adapt a filter transfer function of the first filter unit for the current position of the user's head based on the at least one parameter, wherein the audio output signal depends on the filter transfer function, and wherein as the user moves his/her head, the user's ears move along with the user's head and a distance between the wearable loudspeaker device and the user's ears changes.

9. The system of claim 8, further comprising at least one sensor configured to determine the sensor data, wherein the at least one sensor is at least one of:

integrated in the wearable loudspeaker device;

attached to the user's head; and integrated in a remote sensor unit that is arranged at a certain distance from the user.

10. The system of claim 9, wherein the at least one sensor comprises at least one of:

an orientation sensor;

a gesture sensor;

a proximity sensor; and an image sensor.

11. The system of claim 8, wherein the control unit is configured to adapt the filter transfer function of the first filter unit based on a look-up table, wherein:

the filter transfer function is dependent on a value of at least one control parameter of the first filter unit;

the look-up table includes multiple values, value ranges and/or combinations of values or value ranges of the at least one parameter; and each value, value range and/or combination of values or value ranges of the at least one parameter is linked to at least one value and/or combination of values of at least one control parameter.

12. The system of claim 8, further comprising at least one second filter unit coupled in series to the first filter unit, wherein the control unit is configured to adapt the filter transfer function of the first filter unit and the at least one second filter unit based on the at least one parameter related to the current position of the user's head in relation to the wearable loudspeaker device.

13. The system of claim 8, further comprising:

at least one second filter unit coupled in parallel to the first filter unit;

a plurality of multiplication units, wherein each multiplication unit is coupled in series to each filter unit, and wherein the control unit is configured to determine a weighting gain value depending on the at least one parameter related to the current position of the user's head in relation to the wearable loudspeaker device, wherein the weighting gain value is multiplied with an audio output signal of each filter unit resulting in a mixed audio signal; and an adder configured to sum the mixed audio signals of the plurality of mixers to generate an audio output signal.

14. The system of claim 8, further comprising a gain unit, wherein the control unit is configured to adapt a gain of the gain unit for the current position based on the at least one parameter related to the current position of the user's head in relation to the wearable loudspeaker device, wherein the gain of the audio output signal depends on the gain of the gain unit.

15. A method for operating a wearable loudspeaker device, the method comprising:

determining sensor data;

determining at least one parameter related to a current position of a user's head in relation to the wearable loudspeaker device in response to the sensor data, the wearable loudspeaker device is arranged to be worn on an upper part of a body of the user distant to the user's ears and head;

adapting a filter transfer function of at least one filter unit for a current position of the user's head based on the at least one parameter; and outputting an audio output signal to at least one loudspeaker of the wearable loudspeaker device based on the filter transfer function, wherein as the user moves his/her head, the user's ears move along with the user's head and a distance between the wearable loudspeaker device and the user's ears changes.

16. The method of claim 15, wherein adapting the filter transfer function of the at least one filter unit comprises compensating at least partly for variations of a transfer function between the at least one loudspeaker of the wearable loudspeaker device and at least one ear of the user for various positions of the user's head in relation to the wearable loudspeaker device by employing an approximate or exact inverse transfer function for any position of the user's head which is not an initial position.

17. The method of claim 15, wherein the at least one parameter related to the current position of the user's head in relation to the wearable loudspeaker device is determined based on data acquired from at least one sensor located at one or more of:

the wearable loudspeaker device;

a second device attached to the user's head; and a third device remote to the user and to the wearable loudspeaker device.

18. The method of claim 17, wherein the sensor data is dependent on at least one of:

the current position of the user's head in relation to the wearable loudspeaker device;

a position of the user's head in relation to the third device; and a position of the wearable loudspeaker device in relation to the third device.

19. The method of claim 15, wherein:

adapting the filter transfer function of the at least one filter unit comprises adapting control parameters of the at least one filter unit, wherein the filter transfer function is dependent on a value of at least one control parameter.

20. The method of claim 19, wherein:

the control parameters resulting in certain transfer functions of the at least one filter unit are pre-determined prior to or independent of a primary use of the wearable loudspeaker device for multiple values or value ranges or combinations of values or value ranges of the at least one parameter related to the current position of the user's head in relation to the wearable loudspeaker device; and at least one pre-determined control parameter is applied to the at least one filter unit during an intended use of the wearable loudspeaker device in accordance with a current value or combination of values of the at least one parameter related to the current position of the user's head in relation to the wearable loudspeaker device.

* * * * *